US006220087B1

(12) United States Patent
Hache et al.

(10) Patent No.: US 6,220,087 B1
(45) Date of Patent: Apr. 24, 2001

(54) METHOD FOR DETERMINING EQUIVALENT STATIC MUD DENSITY DURING A CONNECTION USING DOWNHOLE PRESSURE MEASUREMENTS

(75) Inventors: Jean-Michel Hache, Houston; Iain Rezmer-Cooper, Sugar Land; Kais Gzara, Stafford; Mark W. Hutchinson, Houston, all of TX (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 09/487,504

(22) Filed: Jan. 19, 2000

Related U.S. Application Data

(60) Provisional application No. 60/156,760, filed on Sep. 29, 1999, and provisional application No. 60/123,075, filed on Mar. 4, 1999.

(51) Int. Cl.[7] ..... E21B 44/00

(52) U.S. Cl. ..... 73/152.46

(58) Field of Search ..... 73/152.46, 152.19; 367/82; 166/250.15

(56) References Cited

U.S. PATENT DOCUMENTS

| | | | | |
|---|---|---|---|---|
| 3,595,075 | * | 7/1971 | Dower | 73/152.19 |
| 3,971,926 | * | 7/1976 | Gau et al. | 708/3 |
| 4,120,097 | | 10/1978 | Jeter . | |
| 4,216,536 | | 8/1980 | More . | |
| 4,414,846 | | 11/1983 | Dublin, Jr. et al. . | |
| 4,697,650 | | 10/1987 | Fontenot . | |
| 4,733,233 | * | 3/1988 | Grosso et al. | 367/82 |
| 5,654,503 | | 8/1997 | Rasmus . | |
| 5,732,776 | * | 3/1998 | Tubel et al. | 166/250.15 |
| 6,021,377 | * | 2/2000 | Dubinsky et al. | 702/9 |

FOREIGN PATENT DOCUMENTS

| | | |
|---|---|---|
| 64702/98 | 10/1998 | (AU) . |
| 0 489 447 A1 | 6/1992 | (EP) . |
| 0 709 546 A2 | 5/1996 | (EP) . |
| 2 312 456 | 10/1997 | (GB) . |
| 2 323 873 | 10/1998 | (GB) . |

OTHER PUBLICATIONS

C.D. Ward and E. Andreassen, "Pressure while Drilling Data Improves Reservoir Drilling Performance," SPE/IADC 37588, presented at the 1998 SPC/IADC Drilling Conference in Amsterdam, the Netherlands (Mar. 4–6 1997).

P.L. Moore, *Drilling Practices Manual*, pp. 292–295, PennWell Books (Tulsa, Oklahoma 1974).

A. Bourgoyne Jr., K. Millheim, M. Chenevert & F. Young Jr., *Applied Drilling Engineering*, SPE Textbook Series, v. 2, pp. 292–294 (Richardson, Texas 1986).

"PWD® Services Helps Optimize Drilling Efficiency," Sperry–Sun Drilling Services *Technology Update* Spring 1998 (Apr. 1998).

UK Patent *Office Serch Report Under Section* 17, Apr. 18, 2000.

(List continued on next page.)

*Primary Examiner*—Hezron Williams
*Assistant Examiner*—Jay L. Politzer
(74) *Attorney, Agent, or Firm*—John J. Ryberg; Steven L. Christian

(57) ABSTRACT

The present invention presents a method that effectively provides the near real-time advantage of annular pressure while drilling (APWD) measurements taken during pipe connections that require the mud circulation pumps to be turned off (a "pumps-off" condition). APWD data, such as pressure measurements, are obtained from instruments and related electronics within the bottom-hole assembly (BHA). APWD data can be measured, stored and even processed in the BHA during a pumps-off condition for subsequent processing or communication of a reduced amount of data to the driller at the surface.

25 Claims, 6 Drawing Sheets

OTHER PUBLICATIONS

R. Rudolf, P. Suryanarayana, "Field Validation of Swab Effects while Tripping–in the Hole on Deep, High Temperature Wells," IADC/SPE 39395, pp. 835–840, presented at the 1998 IADC/SPE Drilling Conference (Dallas, Texas Mar. 3–6 1998).

M. Hutchinson, Iain Rezmer–Cooper, "Using Downhole Annular Pressure Measurments to Anticipate Drilling Problems," SPE 49114, pp. 535–549, presented at the 1998 SPE Annual Technical Conference (New Orleans, Louisiana Sep. 27–30 1998).

P. Isambourg and D. Bertin, "Field Hydraulic Tests Improve HPHT Drilling Safety and Performance," SPE 49115, pp. 551–563, presented at the 1998 SPE Annual Technical Conference (New Orleans, Louisiana Sep. 27–30 1998).

C. Ward and R. Clark, "Anatomy of a Ballooning Borehole using PWD," *Elf exploration Production* F–64018, pp. 213–220 (1998).

P.Charlez, M.Easton, G. Morrice and P. Cenergys, "Validation of Advanced Hydraulic Modeling using PWD Data," OTC 8804, pp. 1–9, presented at 1998 OTC Conference (Houston, Texas May 4–7 1998).

W. Aldred, J.Cook, P.Bern, B.Carpenter, M.Hutchinson, J.Lovell, I.Rezmer–Cooper, & P.Leder, "Using Downhole Annular Pressure Measurements to Improve Drilling Performance," Schlumberger *Oilfield Review*, pp. 40–55 (Chester, England Winter 1998).

* cited by examiner

METHOD FOR DETERMINING EQUIVALENT STATIC MUD DENSITY DURING A CONNECTION USING DOWNHOLE PRESSURE MEASUREMENTS

This present application claims the benefit of U.S. Provisional Application No. 60/156,760 filed September 29, 1999. This is a continuation application claiming priority from provisional patent application serial number 60/123,075 filed on Mar. 4, 1999.

BACKGROUND OF THE INVENTION

1. Field of the Invention

The present invention provides an improved method for determining the pressure and equivalent static density of drilling mud during pipe connections made in the process of drilling a well.

2. The Related Art

Wells are generally drilled to recover natural deposits of hydrocarbons and other desirable, naturally occurring materials trapped in geological formations in the earth's crust. A slender well is drilled into the ground and directed to the targeted geological location from a drilling rig at the surface. In conventional "rotary drilling" operations, the drilling rig rotates a drillstring comprised of tubular joints of steel drill pipe connected together to turn a bottom hole assembly (BHA) and a drill bit that is connected to the lower end of the drillstring. During drilling operations, a drilling fluid, commonly referred to as drilling mud, is pumped and circulated down the interior of the drillpipe, through the BHA and the drill bit, and back to the surface in the annulus. It is also well known in the art to utilize a downhole mud-driven motor, located just above the drill bit, that converts hydraulic energy stored in the pressurized drilling mud into mechanical power to rotate the drill bit. The mud circulating pumps that pump the drilling mud and thereby power the mud-driven motor are sealably connected to the surface end of the drillstring through the standpipe and a flexible hose-like connection called a kelly.

When drilling has progressed as far as the drillstring can extend without an additional joint of drillpipe, the mud circulating pumps are deactivated and the end of the drillstring is set in holding slips that support the weight of the drillstring, the BHA and the drill bit. The kelly is then disconnected from the end of the drillstring, an additional joint of drillpipe is threaded and torqued onto the exposed, surface end of the drillstring, and the kelly is then reconnected to the top end of the newly connected joint of drillpipe. Once the connection is made, the mud pumps are reactivated to power the drill motor and drilling resumes.

To isolate porous geologic formations from the wellbore and to prevent collapse of the well, the well is generally cased with tubular steel pipe joints connected together to form a casing string. Casing is set in progressively smaller diameter sections as drilling progresses. Downhole conditions and the physical properties of drilled formations determine when a section of casing must be set in order to isolate exposed wellbore. During drilling operations, the drillstring extends through the casing and into the wellbore, and rotates the drill bit against rock and geologic formations lying below the end of the hole.

The fluid pressure in porous and permeable geologic formations is generally balanced by the hydrostatic pressure in the well applied by the column of drilling mud. Pressurized drilling mud is pumped into the surface end of the drillstring by pumps that circulate mud down through the interior of the drillstring, through the BHA and drill bit and back up to the surface through the annulus. Drilling mud is designed to balance formation pressure, cool and lubricate the drillstring and drill bit, and to suspend and carry back to the surface small bits of rock called cuttings that are produced in the drilling process.

The driller generally controls hydrostatic pressures in the well by use of weighting agents added to the drilling mud to increase its density. During a pipe connection, there is no pressure applied to the drilling mud by the mud circulating pumps because the kelly is disconnected from the drillstring. As drilling progresses, additional joints of drillpipe must be connected to the drillstring at the surface to extend the reach of the drilling rig towards deeper objectives. During each pipe connection, several transients contribute to the downhole pressure. These transients are typically dynamic in nature, and the downhole pressure, (and the corresponding data representing the downhole pressure trace), comprise a continuous summation of these transients, which generally changes or fluctuates throughout the duration of each pipe connection, thereby resulting in what is referred to herein as a downhole pressure trace. Factors giving rise to transients that may contribute to or affect the downhole pressure trace during a pipe connection include:

(a) movement of the drillstring within the wellbore (rotation or reciprocation), (b) temperatures and temperature gradients throughout the wellbore, (c) pressure gradients and propagation rates of pressure fronts throughout the wellbore, (d) mud viscosity, compressibility, and other static and dynamic fluid properties of the drilling mud, and their physical sensitivities to changes in temperature, (e) drilling mud weighting agents and loading of cuttings from drilling, and uniformity or non-uniformity of dispersal of both in the mud, (f) fluid flows into and out of the wellbore, both at the surface and downhole, (g) elastic and inelastic expansion of the wellbore and casing, (h) elastic expansion and elongation of the drillstring, and (i) frictional pressure losses due to wellbore geometry and mud rheology.

Many types of geologic formations commonly encountered in drilling will fracture and fail if subjected to excessive downhole pressure in the well. Many types of fluid-bearing geologic formations are porous or permeable, and may either flow fluid into the wellbore or accept fluids from the wellbore with fluctuations in downhole pressure. Successful drilling requires that the drilling fluid pressure remains within a mud-weight window defined by the pressure limits for wellbore stability. The lower pressure limit is either the pore pressure in the exposed formation or the limit for avoiding wellbore collapse. The upper limit is the formation fracture pressure.

If the downhole pressure during a pipe connection exceeds the formation fracture pressure, the region of the formation exposed to the downhole pressure will physically fracture and the fracture will propagate, causing drilling mud to flow from the wellbore into the fractured formation. The rate of mud loss to the fractured formation will be determined by the extent of the fracture and the pressure differential from the wellbore into the formation. The resulting loss of height of the hydrostatic column of drilling mud can quickly result in inadequate downhole pressure at the formation and a rapid loss or reversal of the pressure differential. When this occurs, formation fluids, including gases, may enter the wellbore from the fractured formation or from other formations in fluid communication with the well. This occurrence is commonly referred to as a "kick." Once introduced into the wellbore, a gas kick, for example, migrates upwardly through the drilling mud towards the surface. The upwardly migrating gas continuously expands as it encounters progressively lower pressures, often forcing drilling mud to flow out of the well either at the surface or into formations in fluid communication with the well. This is a dangerous well control situation that should be avoided, but when it happens, it must be detected early and responded to quickly.

A well control situation can also develop if the downhole pressure during a pipe connection falls below the pore pressure of fluids that reside in porous formations. This condition is commonly referred to as "underbalanced." When the well is underbalanced, fluids from porous geologic formations in fluid communication with the well will flow into the well, displacing drilling mud upwardly towards the surface. When, for example, gas is introduced into the wellbore during underbalanced conditions, it can migrate towards the surface and expand, forcing drilling mud to flow out of the well either at the surface or into formations in fluid communication with the well.

The "window of safety" or range of allowable downhole pressures during a pipe connection may be defined by the higher of the formation pore pressure or the wellbore collapse pressure (minimum) and the formation fracture pressure (maximum). The window of safety defined by these minimum and maximum pressures is narrower for wells that are developed:

(a) in deep water locations, (b) as higher formation pore pressures, higher formation temperatures or formations with lower fracture pressures are encountered, (c) in extended reach wells, and (d) in wells with extremely slender boreholes with increased friction losses for required circulating mud pressures.

Downhole instruments have been developed to provide accurate measurements of downhole pressures. Some of these instruments have a cabled connection for transmitting data back to the surface. These instruments are usually slim pieces of equipment that are run into the well inside the drillstring. Virtually unlimited amounts of real-time data can be transmitted to and used by the driller at the surface using these cabled instruments. However, most cabled instruments cannot be used during active drilling phases of the operation or without severely impairing drilling operations. The cable and the instrument must usually be fully withdrawn from the well during drilling operations, including pipe connections, when the downhole data is needed most. Cabled instruments can also be run into the well after the drillstring is removed from the wellbore, but this mode does not apply to pipe connections that occur only when the drillstring is in the well.

A mud pulse telemetry communication system for communicating data from the BHA to the surface has been developed and has gained widespread acceptance in the industry. Mud pulse telemetry systems have no cables or wires for carrying data to the surface, but instead use a series of pressure pulses that are transmitted to the surface through flowing, pressurized drilling fluid. One such system is described in U.S. Pat. 4,120,097. A limitation with mud pulse telemetry systems is that data transmission capacity, or information transmission rate, is extremely limited. Also, data gathered and/or stored downhole in bottom-hole assemblies (BHA) can only be transmitted to the surface using mud pulse telemetry when the mud circulation pumps are active and mud flow is within a certain range, i.e. during "pumps-on" operations. For example, the standard flow range for the Schlumberger 6.75-inch PowerPulse™ MWD Tool is 275–800 gallons per minute. During pipe connections, a "pumps-off" operation, no downhole data can be transmitted to the surface using mud pulse telemetry systems. Although many downhole pressures occurring during pipe connections can be accurately measured and stored in the BHA during the pipe connection, this data can only be transmitted via mud pulse telemetry to the surface after the circulating pumps have been turned back on, and even then, the rate of data transmission is very slow. Consequently, by the time that several pressures measured and stored in the BHA during the pipe connection are available to the driller, any well conditions arising as a result of mud loss or gas influxes occurring during the pipe connection are considerably advanced. The ability of the driller to address dangerous well conditions is irreparably harmed by the extreme delay in obtaining downhole pressure measurements made during the pipe connection. Knowing the downhole pressure trace during pipe connections could provide the driller with a valuable tool for designing and managing the drilling process. Drillers are currently without this valuable information during pipe connections, and this problem can result in well control situations that increase the cost of and compromise the success of the drilling venture.

Attempts have been made to formulate a predictor equation for use in estimating downhole conditions, including pressure, based on surface measurements. Rasmus discloses in his U.S. Pat. No. 5,654,503 a method for obtaining improved measurement of drilling conditions. Rasmus attempts to overcome the limited information transmission rate of mud pulse telemetry systems by formulating a predictor equation relating a surface condition to a related downhole condition at a given time. The Rasmus predictor equation is formulated by using a downhole instrument in the BHA to make numerous downhole measurements over a given time period. Rasmus then averages these measurements in a downhole CPU, and sends the averaged downhole condition measurement to the surface for comparison with actual related surface condition measurements.

The Rasmus method may be used to approximate downhole pressure based on surface pressure. However, the Rasmus method fails to compensate for influences from pipe movement (rotation or reciprocation), cuttings distribution, and fluid flow into and out of the wellbore, or combinations of these influences, that can cause deviations and transients in the downhole measurements. By taking an average of numerous measurements of the downhole pressure, the Rasmus method irreversibly mixes the influence of these transients into the averaged downhole value, which is then communicated to the surface for comparison to an accurate surface pressure measurement. Furthermore, the Rasmus method uses a cumbersome sequencing technique to time-shift and re-align downhole data averages with selected surface measurements.

In other words, Rasmus correlates an average taken over a given period of time, for example, 30 seconds, with a single surface measurement taken sometime during or prior to that 30-second period. Substantial inaccuracies are introduced in the averaging step and again in the time sequencing step, and these result in a poor approximation of coefficients used in the Rasmus predictor equation to reconstruct a highly sampled synthetic downhole pressure and to diagnose well conditions.

What is needed is a method of accurately estimating downhole pressures occurring during pipe connections that allows the driller to use a limited amount of strategically selected pressure data taken downhole to accurately diagnose well conditions and well behavior occurring during pipe connections. What is needed is a method of selecting and communicating only those specific downhole measurements that provide the most beneficial information for quickly and accurately diagnosing well conditions arising during pumps-off operations such as pipe connections. This method would thereby enable the driller to take appropriate remedial steps in response to adverse well conditions before a substantial problem develops.

SUMMARY OF THE INVENTION

The present invention provides a method of determining a representative equivalent static downhole annular fluid pressure. According to the method, the downhole annular fluid pressure is measured by the bottom hole assembly (BHA) during a pipe connection. The BHA then identifies the onset of a pumps-off condition, which is identified based on the LTB (Low-power Tool Bus). The LTB provides a line of communication between the MWD and LWD tools and also supplies voltage to some of the LWD electronics. More precisely, the APWD pumps-off analysis is started when both of the following conditions are met:

(i) No LTB communication for at least 10 seconds, and (ii) Very low LTB voltage (e.g. LTB voltage<1 Volt)

The pumps-off analysis is continued as long as both the above conditions are TRUE. The BHA also identifies an end-of-connection condition from the measured pressure by detecting the sudden changes that would result from moving the pipe or reactivating the mud circulating pumps. The BHA, preferably through computer implemented means, estimates an equivalent static downhole annular fluid pressure using only the downhole annular fluid pressure measurements that were taken between the onset of the pumps-off condition and the end-of-connection condition. . The step of estimating the effective static downhole annular fluid pressure may include fitting the downhole annular fluid pressure measurements between the pumps-off condition and the end-of-connection condition to an equation, preferably where the equation represents the effective static downhole annular fluid pressure as equal to the downhole annular fluid pressure less the sum of pumps-off transients.

Downhole annular pressure measurements can be used to determine equivalent mud density by dividing the measured pressure by true vertical depth (TVD), which is known at the surface. Equivalent density is typically referred to as equivalent circulating density (ECD), which is technically the equivalent mud density when the mud is circulating. When the mud is not circulating, equivalent density is referred to as equivalent static density (ESD). ECD is often used as a general term to encompass both ECD and ESD, and is an important parameter that represents an integrated measure of the fluid behavior in the annulus.

The static downhole pressure $P_{Static}$ determined by the BHA is then communicated to the driller at the surface, preferably using mud pulse telemetry communication immediately following the resumption of pumps-on operations after the pipe connection. It is then converted into ESD, which provides the driller with valuable information enabling faster diagnosing of, and response to, developing well conditions.

Optionally, the method may further comprise the steps of measuring additional downhole pressure measurements occurring at other strategically selected locations on the downhole pressure trace, recording the times or locations at which each of the additional measurements were made, and communicating these additional measurements and corresponding locations to the surface. The additional downhole data communicated to the surface allows correlation of measured downhole data with surface pressure data in order to estimate the downhole pressure trace occurring during a pumps-off condition. The preferred application for all of these methods is for the determination of well conditions occurring during a pipe connection.

BRIEF DESCRIPTION OF DRAWINGS

So that the features and advantages of the present invention can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENTS

Figure 1:
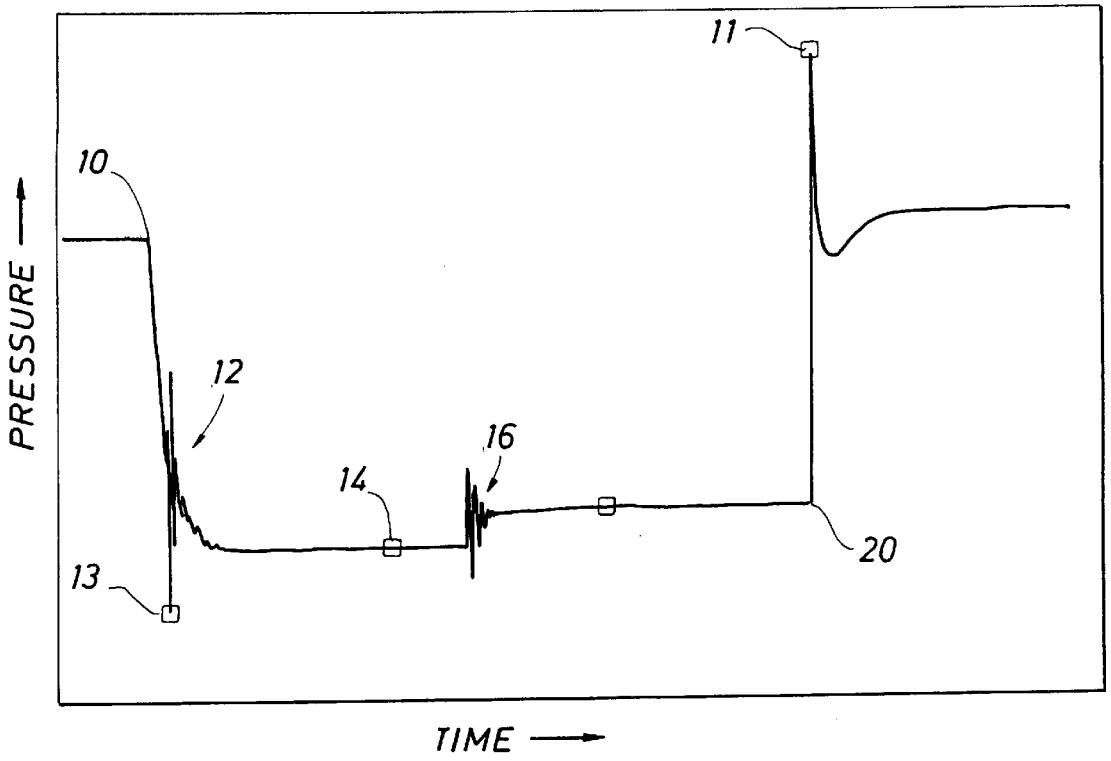
FIG. 1 is a graph of a typical APWD profile during a pipe connection.

The present invention provides a method that effectively restores the real-time advantage of annular pressure while drilling (APWD) measurements taken during pipe connections. APWD data is obtained using instruments and related electronics in the BHA, and communicated to the surface using a mud pulse telemetry system that works only when mud pumps are active. Pipe connections require deactivation of the mud circulation pumps. Consequently, communication of downhole data to the surface using mud pulse telemetry is unavailable during a pipe connection. During the pipe connection, much APWD data can be measured and stored in the BHA, and subsequently communicated to the driller at the surface after resumption of pumps-on operations. However, information transmission rates for mud pulse telemetry systems are very slow. It is desirable to provide the driller with critical downhole data enabling him to quickly diagnose developing well conditions occurring during the pipe connection. The present invention overcomes the low information transmission rate of mud pulse telemetry systems to restore near real-time quality to APWD data by using downhole intelligence to strategically identify certain landmark events that occur during the pipe connection, and then using the identified events and the pressure measurements taken in relation to those events to determine certain critical parameters for transmission to the surface, optionally including a small number of the most beneficial APWD measurements along with their locations on the downhole pressure trace. After pumps-on operations are resumed, the BHA communicates the selected or processed data to the surface using mud pulse telemetry.

Generally, analog APWD data is converted by a logic circuit or central processing unit (CPU) in the BHA to digital form. When pumps-on operations resume after the pipe connection, the stored data is transmitted from the BHA to the surface one bit at a time making transmission of pressure readings extremely slow. While many APWD measurements may be taken, recorded and stored in the BHA, communication of data from the BHA to the surface cannot commence until after pumps-on operations resume. As a result of low information transmission rate of drilling mud and rapid changes in wellbore conditions, very few APWD measurements or other data can currently be communicated to the surface fast enough for it to be reasonably useful to the driller for near real-time diagnostics or control of the drilling operations.

APWD data measured and recorded in the BHA may also be processed in the BHA. Using this advantage, a reduced amount of processed APWD data, or a small set of strategically selected APWD data, may be quickly communicated to the driller at the surface to provide more useful information regarding well conditions that a mere stream of pressure measurements which the driller must then analyze. In essence, appropriate downhole analysis goes a long way toward overcoming the delay in availability and the slow rate of information transmission associated with the mud telemetry system. The invention uses the advantage of being able to process data downhole to minimize the delay in providing critical downhole information to the driller and increase the speed with which the driller can respond to undesirable well conditions.

When a connection cycle takes place, several dynamic transients related to well operations and physical changes in the well contribute to the overall downhole pressure trace recorded in the BHA. Each transient contributing to the overall downhole pressure trace has a distinctly different "signature" related to its energy dissipation profile. This signature reflects the mode of energy decay attributable to the physical changes behind the transient. When these characteristic energy decay signatures occur simultaneously, the overall downhole pressure trace comprising the sum of these transients may appear to fluctuate without a readily identifiable pattern unless it is analyzed in light of known contributing energy decay signatures. The overall downhole pressure trace cannot, therefore, be reliably approximated using means, averages, standard deviations, or other simple mathematical approximations. As a result, any estimate or modeling of the downhole pressure trace during connections that does not take these dynamic transients into consideration is unreliable.

Figure 5A:
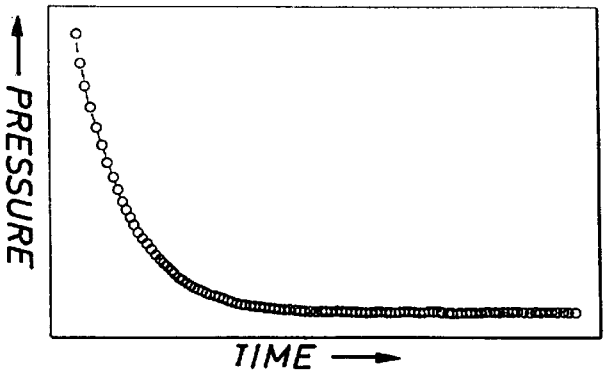
FIG. 5 includes graphical depictions of five common energy decay profiles for transients that may contribute to the overall downhole pressure trace.
Figure 5B:
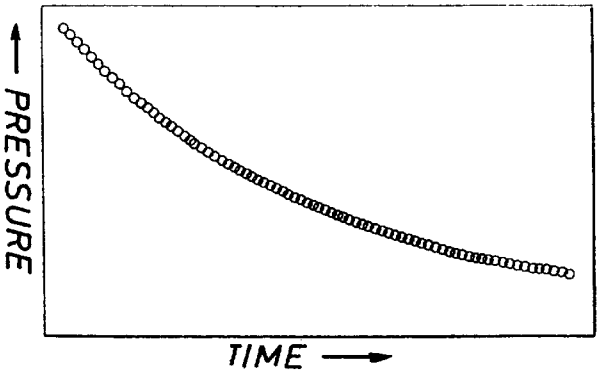
Figure 5C:
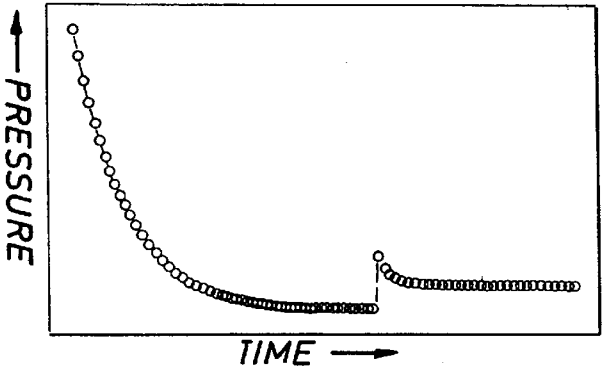
Figure 5D:
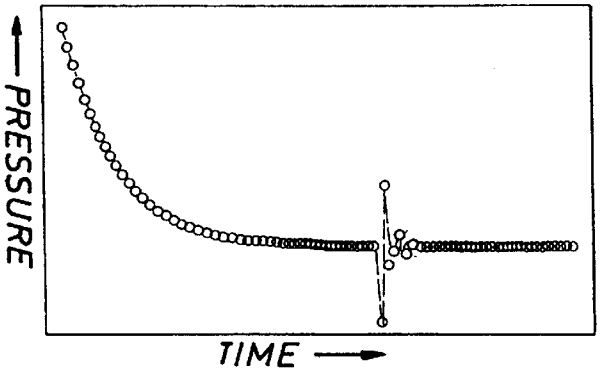
Figure 5E:
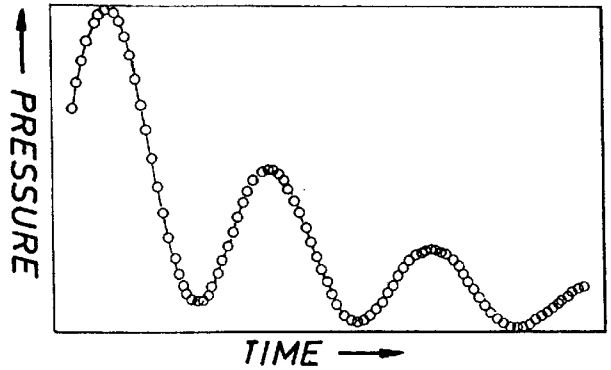

The depictions in FIG. 5A–E below show the range of profiles of the principle transients that contribute to the overall downhole pressure trace. FIG. 5A describes 'minimal wellbore ballooning'. FIG. 5B describes more significant ballooning. Ballooning refers to both the physical deformation of the wellbore geometry (wellbore elasticity or compliance), and the taking and giving back of drilling fluid (wellbore storage), in response to changes in the wellbore pressure. While drilling some formations, the ECD is high enough to initiate a network of micro-fractures and/or to force drilling fluid into a preexisting network of such micro-fractures, as well as causing circumferential expansion of the borehole and casing. When the pumps are turned off, the ECD decreases, the wellbore contracts, and mud is returned from the formation to the borehole. This gives rise to a pressure transient, which can be represented by a single decaying exponential (FIGS. 5A and B). FIG. 5C describes a connection where the pipe has been moved deeper into the well prior to reactivation of the mud circulating pumps. The introduction of an additional volume of steel in the extended drillstring causes displacement of an equal volume of drilling mud and an incremental increase in downhole pressure. FIG. 5D describes a connection where the drillstring is reciprocated prior to reactivation of the mud circulating pumps. FIG. 5E describes the influence of BHA harmonic oscillation after the drillstring is set in the slips.

This wide variety of profiles is what makes pumps-off analysis challenging. Simply transmitting the minimum pressure ($P_{Min}$) and/or average downhole pressure ($P_{Ave}$) based on recorded APWD data obtained during the pipe connection can be very misleading and may result in erroneous interpretation of the ESD occurring during the pipe connection. The error associated with using the minimum downhole pressure and/or average downhole pressure based on the APWD measurements recorded during a pipe connection will depend on a variety of factors, including:

i. well geometry (depth, diameter and inclinations);
ii. drillstring geometry;
iii. mud properties;
iv. the speed with which the drillstring is reciprocated in the well;
v. the speed with which the drillstring is set in the slips;
vi. the extent to which ballooning is present;
vii. the depth interval to which the drillstring is lowered after the pipe connection (before turning the pumps back on); and
viii. the duration of the pipe connection.

These known contributing transients must be acknowledged and dealt with in order to arrive at a more reliable estimate of the overall downhole pressure trace and, in particular, the ESD. A BHA that can analyze the pressure measurement in light of these known transitional behaviors during a pipe connection, can provide a small amount of much more useful data to be communicated to the driller after the pipe connection, thereby enabling the driller to more rapidly and accurately diagnose developing well conditions.

FIG. 1 shows a typical downhole pressure trace occurring during a pipe connection. According to the present invention, the typical downhole pressure trace exhibits several "events" that divide the overall downhole pressure trace into regions of interest. The downhole pressure trace begins when the mud circulating pumps are deactivated at the onset of the pipe connection 10, and ends when the mud circulating pumps are reactivated.

When the drillstring is set in the slips at the onset of the pipe connection 10 and the mud circulating pumps are deactivated in order to connect an additional joint of drillpipe, the APWD exhibits a substantial decrease. The downhole pressure trace exhibits a marked drop 12 from the circulating pressure ($P_{Circulating}$) and a substantial downward adjustment toward the static pressure ($P_{Static}$) 14. The equivalent densities (ECD and ESD) deduced from the pressure measurements taken or occurring after deactivation of the mud circulating pumps and prior to the end of the pipe connection represents a region of particular interest because this period of time, after stabilization from well operations occurs, represents the best estimate of the ESD. The pressure measurements in this region are the best for estimating the ESD since the fluid is not circulating and, over this region, the transients are beginning to decrease in magnitude. In effect, the fluid is approaching a static condition and the pressure measurements taken during the approach to static conditions may be analyzed to determine an ESD even if the fluid is never actually static.

When the mud circulation pumps are deactivated at the beginning of a connection cycle 10, the pressure applied at the surface to the mud in the interior portion of the drillstring generally decreases to atmospheric pressure. In fact, a prudent driller will not allow the kelly to be disconnected from the drillpipe unless the pressure within the standpipe, which is in fluid communication with the mud pump discharge, is safe. However, the mud pump discharge pressure does not instantaneously fall to zero, and the downhole pressure does not instantly drop by the amount of the mud pump pressure removed from the top end of the drillstring by deactivation of the mud pumps. When the mud pump is deactivated and the pressure applied to the drilling mud and other materials in the well falls to atmospheric, a pressure front propagates down the drillstring to the bottom of the well. To the extent that the mud and other materials in the well are compressible, potential energy is stored in these compressible materials as a result of the relatively high circulating pressure applied when the mud circulation pumps are active.

When the mud circulation pumps are deactivated, this stored energy is returned to the system, resulting in an energy decay transient that contributes to the overall downhole pressure trace. The contribution of this energy return to the overall downhole pressure trace can be mathematically modeled.

The maximum downhole pressure recorded during the pipe connection typically occurs when the mud circulating pumps are reactivated 10. A factor that increases this maximum downhole pressure is the gel properties of the drilling mud. Gel properties are designed into the mud in order to suspend weighting agents and drilled cuttings that must be carried to the surface, often through inclined or horizontal sections of the wellbore. A side-affect of gel properties is that they cause substantially increased resistance to the resumption of annular mud flow after the mud has become static during a pipe connection. This increased static mud flow resistance results in an initial pressure surge 11 at the onset of the downhole pressure trace when the mud circulating pumps are reactivated. This maximum pressure surge 11 sometimes results in a higher than desired downhole pressure surge. A downhole pressure surge due to gel resistance of static mud can increase the downhole pressure beyond the formation fracture pressure causing mud loss to the formation.

Drillers often attempt to minimize the mud pump reactivation surge 11 by gradually "trimming" the mud circulating pumps or by bringing the mud pumps back up to full rate slowly, thereby gradually breaking the gelled mud from the static to the dynamic state. Drillers may also attempt to minimize the downhole pressure surge by rotating the drillstring in the well prior to reactivation of the mud pumps to disturb the static mud gel immediately prior to reactivation of the mud pumps. It is important that maximum pressure 11 on the downhole pressure trace be located, recorded and communicated to the surface upon resumption of pumps-on operations. This makes the driller aware of the maximum downhole pressure occurring during the pipe connection, and enables the development and calibration of better mud gel breaking models so that the effectiveness of pipe rotations or reciprocation, or pump "trimming" can be evaluated.

These attempts to rninimize the pressure surge associated with gel breaking, and the gel-breaking phenomenon itself, result in transients with characteristic signatures that contribute to the overall downhole pressure trace. As stated above, pipe reciprocation is a technique often used by the driller to check for stuck pipe due to settling of weighting agents or drilled cuttings during a pumps-off condition, or the "pre-break" gelled mud that has become static during a pumps-off condition. However, downhole portions of the drillstring continue to move when the surface end of the drillstring is stationary. When the drillstring (that is, the combination of the drillpipe, the BHA and the drill bit) is reciprocated or transferred to the slips at the surface, the inertia of the drillstring may cause substantial elongation of the drillpipe. Once set in downward motion, the lower portions of the drillpipe, the BHA and the drill bit continue in motion as the relatively slender drillstring elongates as it elastically resists further elongation due to downward movement of the lower, heavy portions of the drillstring. When downward motion ceases, the potential energy stored in the elongated drillpipe pulls the drillstring upwardly, thereby reversing its motion. As with a dangling weight on the end of an elastic string, the movement of the BHA is characterized by harmonic oscillation within the well, the long frequency oscillation gradually dampened by fluid friction in the drilling mud and pipe stiffness. This is particularly significant in deep, vertical wellbores.

Figure 2:
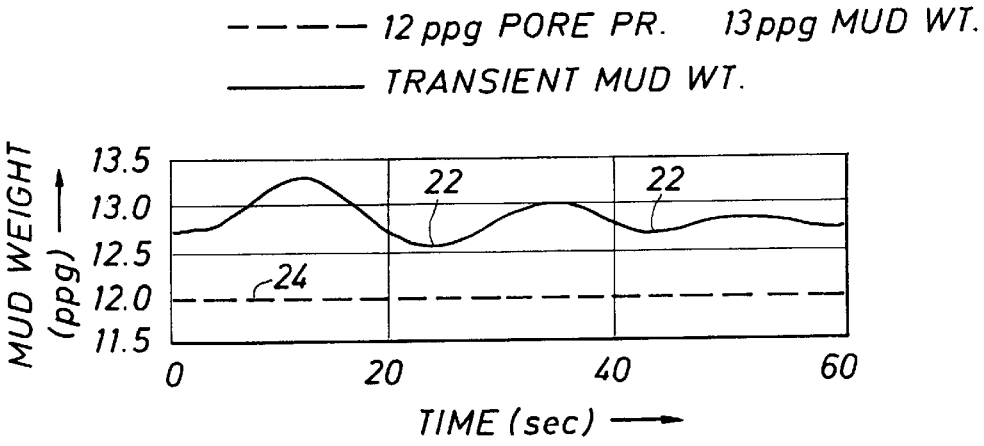
FIG. 2 is a graph showing the alternating swab and surge pressures occurring during harmonic oscillation of the drillstring after reciprocation of pipe or setting the drillstring in the slips.
Figure 3A:
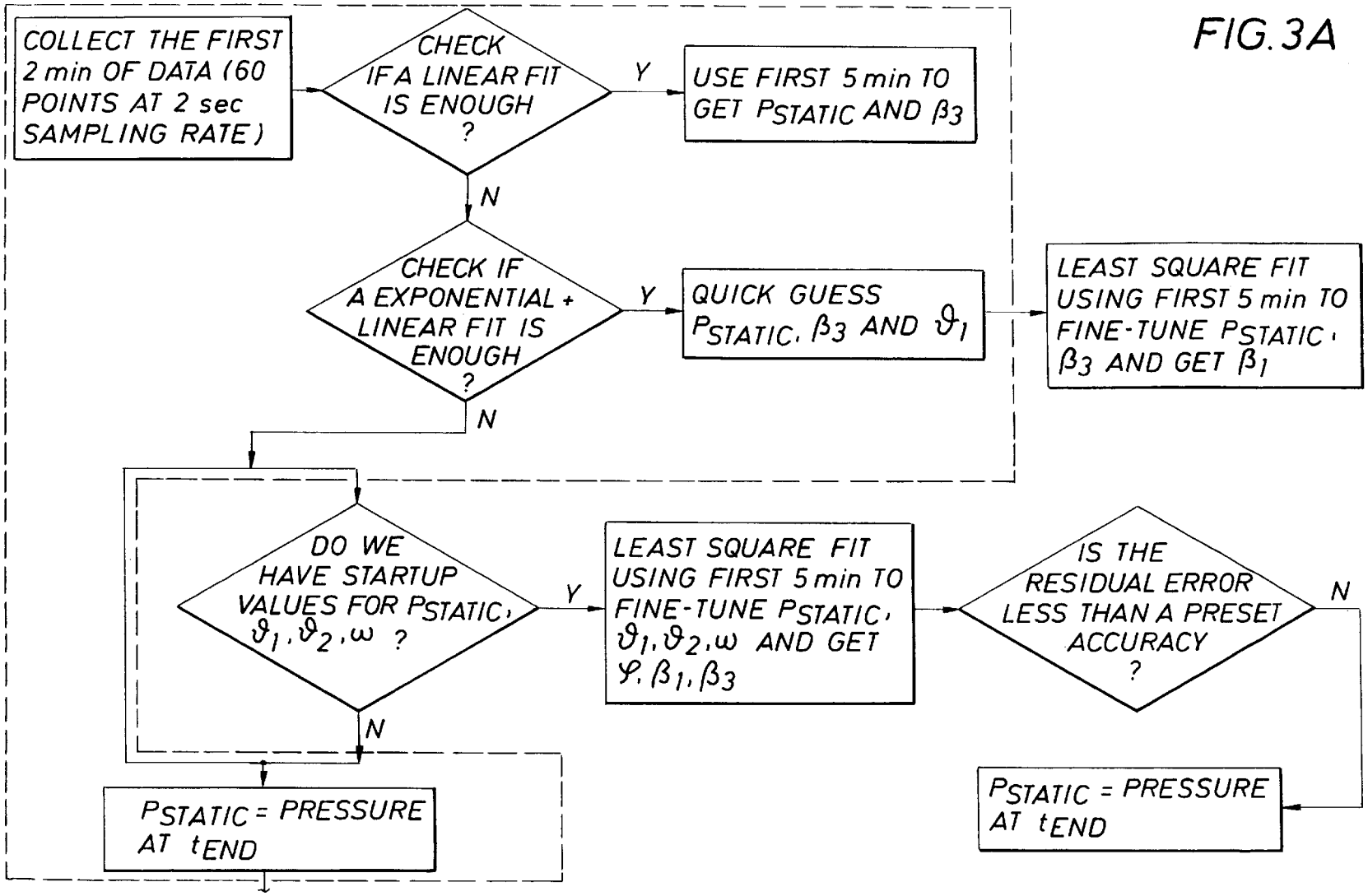
FIG. 3 is a diagram representing the workflow algorithm used in the invention to model the downhole pressure trace.
Figure 3B:
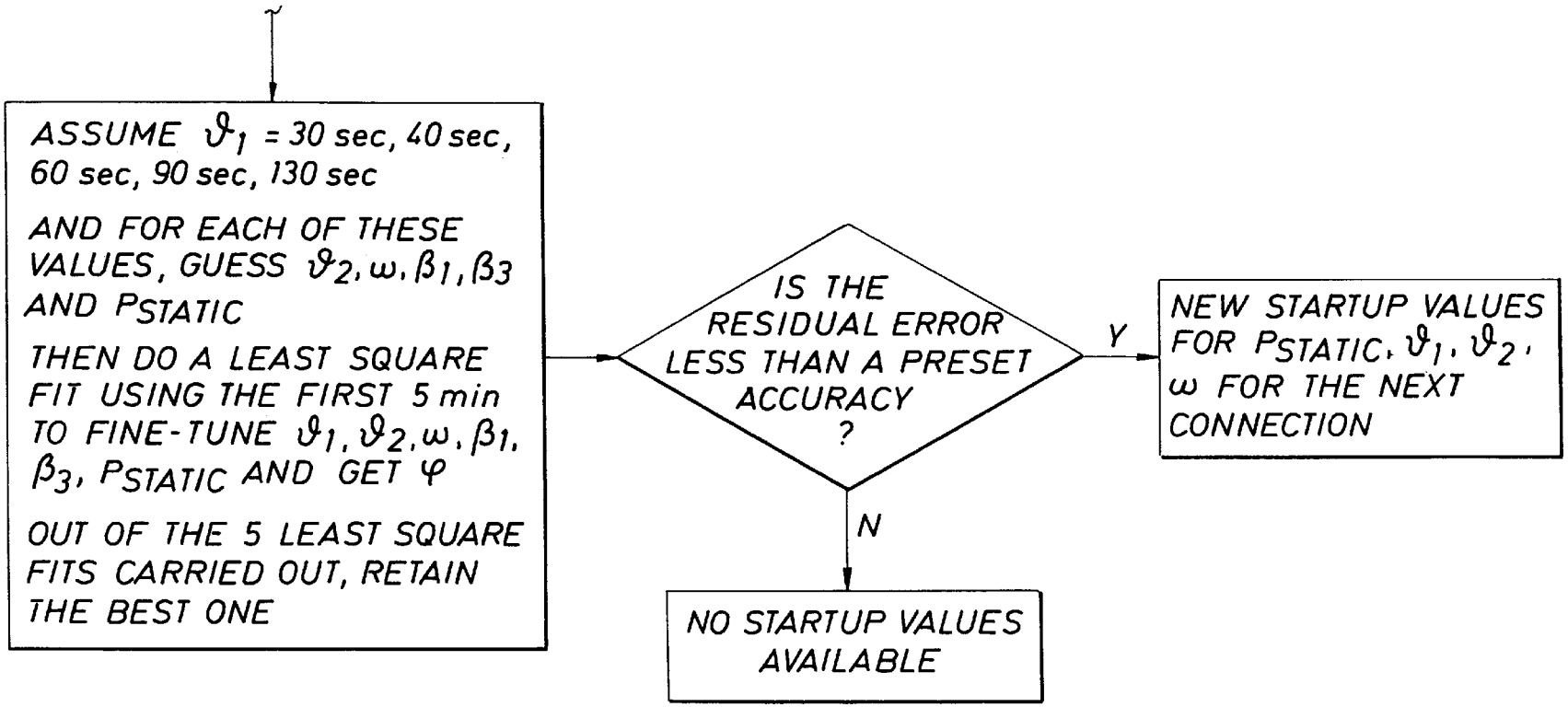
Figure 4A:
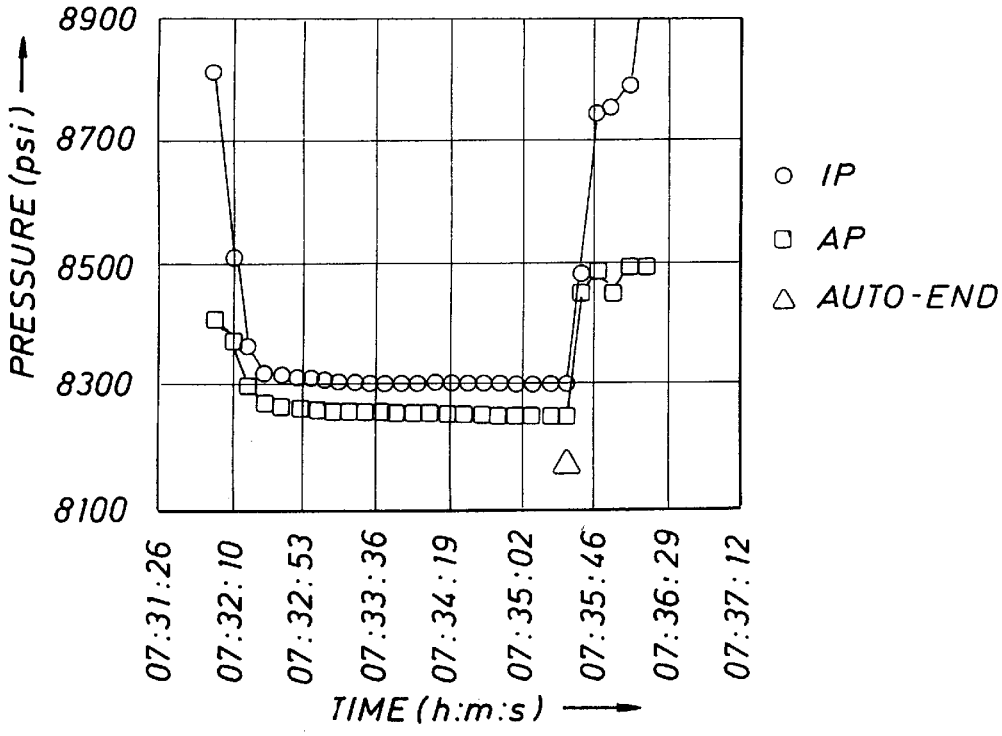
FIG. 4 includes graphs of four APWD profiles during pipe connections and the use of automatic end of connection determination.
Figure 4B:
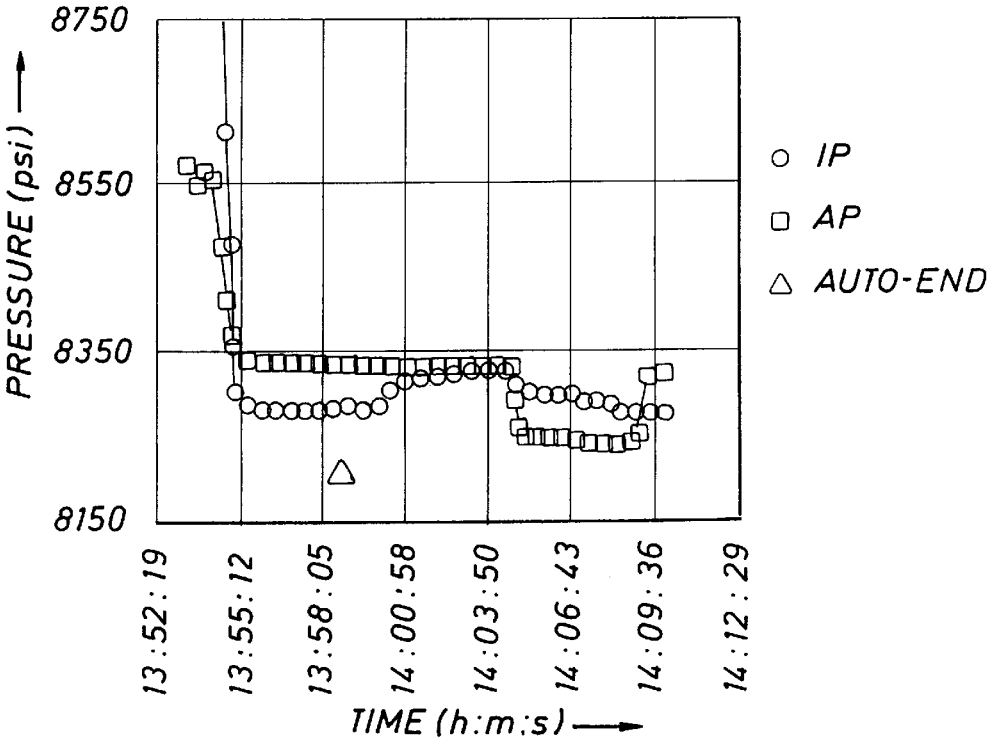
Figure 4C:
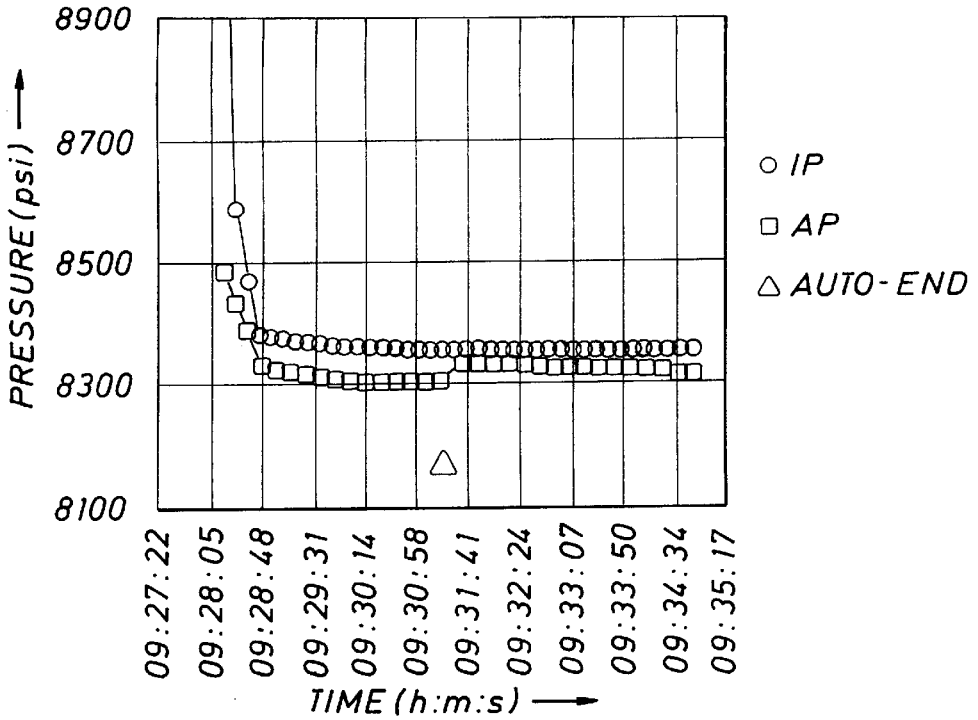
Figure 4D:
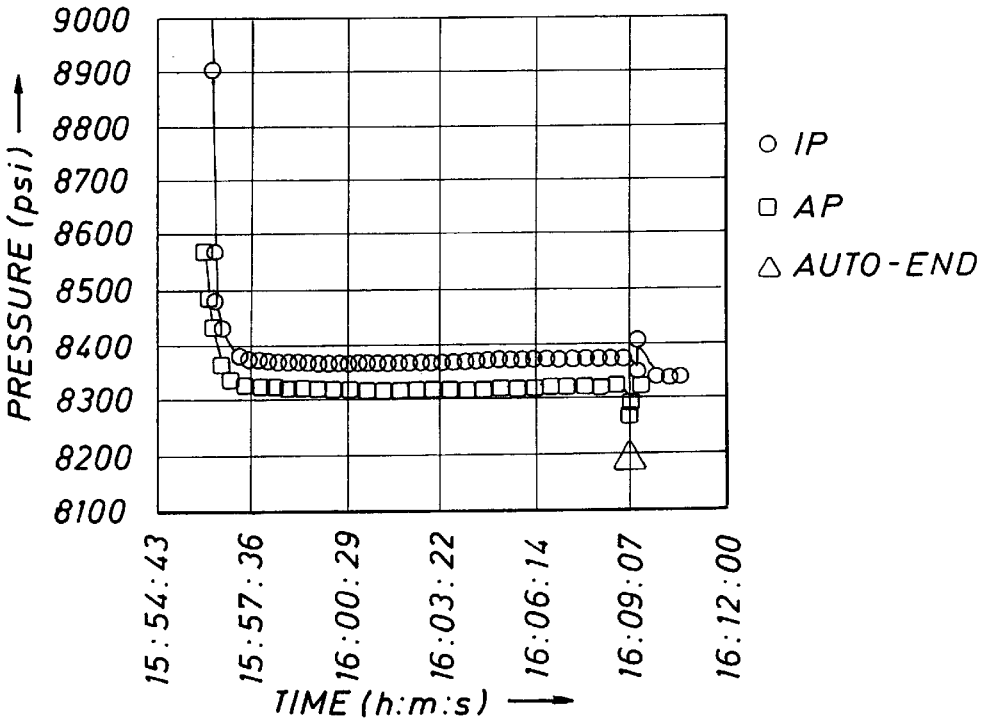

The gradually dampened, cyclic up and down displacement of the BHA and drill bit creates an alternating swabbing and surging pressure component 16 that contributes to the overall downhole pressure trace. Similarly, a positive "surge" pressure occurs when running pipe into the well, and a negative "swab" pressure occurs when pulling pipe out of the well. A "close-up" of the swab-surge transient pressure is shown in FIG. 2. In FIG. 2, the minimum pressure troughs 22 associated with the alternating "swabs" remain above the pore pressure of the fluids in the formation in communication with the well and shown on the graph in terms of a 12.0 pound per gallon mud density 24. A downhole pressure surge due to downward harmonic motion or running pipe into the well can increase the downhole pressure beyond the formation fracture pressure causing mud loss to the formation. Similarly, a swabbed downhole pressure resulting from upward harmonic motion or withdrawal of pipe from the well that falls below the pore pressure of a formation in fluid communication with the well can cause formation gas to be introduced into the well. In addition, sudden deceleration of the drillstring at the surface end can result in a substantial swab pressure downhole that may be sufficient to draw formation fluids into the weilbore and cause a kick. Although the drillstring and wellbore dynamics are beyond the intended scope of this discussion, this phenomenon is further described and explained in "Field Validation of Swab Effects While Tripping-In the Hole on Deep, High Temperature Wells" by R. L. Rudolf and P. V. R. Suryanarayana, SPE paper no. 39395 presented at the 1998 IADC/SPE Drilling Conference in Dallas, Tex., 3–6 March 1998. Harmonic oscillation or pipe reciprocation in the well can be mathematically modeled to enable the correlation with APWD data. Modeling the impact of harmonic oscillation or pipe reciprocation on the overall downhole pressure trace is difficult due to the existence of unknown variables, including compressibility of formation fluids (especially gas), elasticity of tubular strings in the well and inertia of drillpipe or fluids that are set in motion during well operations.

The general profile of the contribution of running drillstring into the well to the overall downhole pressure trace is graphically depicted in FIG. 5C. The general profile of the contribution of pipe reciprocation after a connection to the overall downhole pressure trace is graphically depicted in FIG. 5D. The general profile of the contribution of a harmonic mode oscillation of the BHA to the overall downhole pressure trace is graphically depicted in FIG. 5E. It is important to understand the true nature and profile of each contributing pressure transient. While it is not necessary, or perhaps not even desirable, to exactly model the actual values involved in each contributor to the overall downhole pressure trace, it is important to determine the overall shape and profile of the trace. Once we understand the basic shapes that comprise the pressure transients, we will be able to carry out a proven fit of strategically selected data and to extract or determine the desired ESD 14. It is also important to have a proven, physically-based fit, rather than use empirical and unverifiable fits that may compromise reliability of the results.

Known downhole pressure responses associated with certain surface activities occurring during pipe connections can be effectively used to map out, delineate, or identify regions of interest in the overall downhole pressure trace. As discussed, the general locations on the overall downhole pressure trace of the maximum pressure 11 associated with reactivation of mud circulating pumps and the minimum pressure 13 associated with the onset of harmonic oscillation when the drillstring is set in the slips are known. When the weight of the drillstring is lifted from the mechanical slips after the end of the pipe connection 16, the initial pulling of the pipe from the well produces a noticeable pressure swab in the downhole pressure trace.

Furthermore, a driller will often reciprocate the drillstring in the well to check for and prevent the drillstring from getting stuck in the wellbore by cuttings or weighting agents that settle out of the static drilling mud during the connection. Again, the reciprocation of the drillstring immediately following a period of relative static downhole pressure produces sequential or alternating swab and surge pressure spikes immediately following a period of relatively static downhole pressure. Finally, the driller's reactivation of the mud pumps 20 after a connection has been made and the kelly reconnected causes a significant and detectable increase in the downhole pressure trace to its maximum recorded level 11. As a result of the static nature of the mud in the wellbore and the inertial resistance to the circulating pump, the maximum downhole pressure 11 obtained during the connection generally occurs when the mud circulating pumps are reactivated 20 after a connection.

While obtaining a reliable estimate of the ESD occurring during a pipe connection is the primary focus of this invention, it is an option, within the scope of the present invention, to use the process disclosed herein with any well parameter of interest. Similarly, while the invention is described as overcoming the limited information transmission rate of mud pulse telemetry systems, all other information communications improved through use of selectively detecting, measuring, communicating and correlating critical downhole data to the surface are within the scope of the invention.

Optionally, the strategically selected APWD data may include the maximum and minimum downhole pressures corresponding to the reactivation of mud pumps. Furthermore, the strategically selected APWD data may include data representing the ESD of the drilling mud based on the actual downhole pressure occurring at a selected time interval prior to the end of the connection 16. The strategically selected data may also include data representing the static pressure occurring after the end of the connection 16 but prior to the reactivation of the mud circulating pumps 20.

The first step in the process of estimating the ESD or $P_{Static}$ is determining, from the pressure trace recorded during a connection, the end of the connection 16. The end of the connection necessarily occurs upon reciprocation of the drillstring or reactivation of the mud circulating pumps. The beginning of the connection 10 is marked by deactivation of the mud circulation pumps, which is immediately prior to or after the time that the drillstring is set in the slips. We can assume that the harmonic oscillation, or the alternating swab and surge pressures, associated with setting the drillstring in the slips at the beginning of the pipe connection cycle causes the minimum pressure 13 that occurs during the pipe connection cycle. Accordingly, the ESD or $P_{Static}$ 14 occurs after the minimum pressure (when the drillstring is set in the slips) and prior to the reciprocation of the drillstring or reactivation of the mud circulating pumps. However, because pipe reciprocation can take place after the end of the connection 16 and prior to the reactivation of the mud circulating pumps 20, it cannot be taken for granted that the $P_{Static}$ estimated from an analysis of the entire pumps-off sequence will be a correct estimate.

As stated earlier, we can detect the end of the connection 16 based on the sudden pressure change that accompanies picking up the drillstring off the slips. Intuitively, as long as the drillstring remains supported by the slips and the mud circulating pumps remain inactive, the recorded APWD pressure trace should remain within a range dictated by the recent history of pressure changes. If we refer to the time at which the pumps-off condition is detected as to, then the pumps-off annular pressure measurements will consist of discrete measurements $p(t_n)$ made at the discrete times $t_n=t_0+n\times\Delta t$ where $(\Delta t)$ is the time sampling interval. The time associated with the end of the connection 16, or $t_{End\text{-}of\text{-}Connection}$, is that time $t_N$ when the recorded APWD pressure $p(t_{N+1})$ at $t_{N+1}$ shows a 'sufficient' change from the preceding APWD pressure $p(t_N)$ at time $t_N$, Whether the change is 'sufficient' to trigger the detection of the end of the connection, depends on the recent history (defined by a time span $(\lambda)$) of pressure changes that are considered normal, and takes into account normal changes in the pressure caused by the pressure gauge resolution $(\epsilon)$. In addition, a safety factor $(\eta)$ is introduced to safeguard against artifacts and spurious noise spikes.

Stated mathematically, $t_{End\text{-}of\text{-}Connection}$ is defined as the time just prior to any of the following inequality relationships being violated:

$$\left(\dot{p}(t_{n-1}) - 2\frac{\varepsilon}{\Delta t}\right) + \ddot{p}_{\mathrm{Min}}(t_{n-1}) \times \Delta t \times 2^{-Sign\,[\ddot{p}_{\mathrm{Min}}(t_{n-1})]\cdot\eta} \le \dot{p}(t_n) \tag{1}$$

$$\dot{p}(t_n) \le \left(\dot{p}(t_{n-1}) + 2\frac{\varepsilon}{\Delta t}\right) + \ddot{p}_{\mathrm{Max}}(t_{n-1}) \times \Delta t \times 2^{+Sign\,[\ddot{p}_{\mathrm{Max}}(t_{n-1})]\cdot\eta}$$

where $$\dot{p}(t_n) = \frac{p_{Ann}(t_{n+1}) - p_{Ann}(t_{n-1})}{2\times\Delta t} \tag{2}$$

$$\ddot{p}(t_n) = \frac{p_{Ann}(t_{n+1}) - 2\times p_{Ann}(t_n) + p_{Ann}(t_{n-1})}{(\Delta t)^2}$$

$$\ddot{p}_{\mathrm{Max}}(t_n) = \mathrm{Max}\{\ddot{p}(t_i) \quad \text{for } t_n - \lambda \le t_i \le t_n\}$$

$$\ddot{p}_{\mathrm{Min}}(t_n) = \mathrm{Min}\{\ddot{p}(t_i) \quad \text{for } t_n - \lambda \le t_i \le t_n\}$$

The significance of the safety factor $(\eta)$ is that it allows for changes in the pressure derivative that are larger than those suggested by the recent history of the pressure. When $\eta=0$, the pressure derivative has to stay within the range spanned by the recent history of the pressure. When $\eta\rightarrow+\infty$, sudden changes in the derivative will go unnoticed.

This technique of automatically detecting the end of the connection was validated on real APWD data with $\lambda=50$ sec, $\epsilon=1$ psi and $\eta=0.5$, and the detection of the last valid pressure point for pumps-off analysis was very accurate as shown in FIGS. 5A–D.

In estimating $P_{Static}$, the dominant transients that will control the shape of APWD trace during the pumps-off stage are when:

(a) the BHA resembles a mass hanging down a long elastic string (the drill pipe), and resembles a dampened oscillator, (b) well-bore storage effects (that is hole storage plus formation 'ballooning'), will result in exponential-like decays, (c) there is continuous leakage through the formation corresponding to invasion and cuttings settling down at a 'fixed rate', which are more like an ever-present linear decay or a very flat exponential, and also slow changes in pressure caused by heat exchange mechanisms.

The downhole annular pressure trace at any time t, or $P_{Ann}(t)$, can be mathematically modeled by breaking it down into the sum of basic pressure transients shown in FIGS. 5A–E. An accurate static pressure estimate can be obtained by fitting actual AWPD pressure data to the equation:

$$P_{Ann}(t)=\beta_1 e^{-t/\vartheta^1}+\beta_2\times e^{-t/\vartheta^2}\sin(\omega t+\phi)-\beta_3(t-t_{End})+P_{Static} \quad (2)$$

where $\vartheta_1$ and $\vartheta_2$ are time constants, ω is a frequency, ϕ is a phase, $\beta_1$, $\beta_2$ are amplitudes and $\beta_3$ is a rate of change of pressure with time.

As an additional and optional aspect of this analysis, there are certain alarm conditions that may be indicated by the actual downhole APWD data that are of interest to the driller. These include a very slow decay time constant (indicating "ballooning"), a fast decay (indicating an influx of formation fluid, or a kick), and an unusual pressure gain ($\beta_3<0$) (indicating a gas kick in a slim wellbore or shallow water flow). Since equation (2) contains information beyond $P_{Static}$, alarm conditions can be defined that will call the driller's attention to the existence of any of these well conditions that may be detected. For example, alarms may be activated by checking the APWD data to see if:

(a) $\vartheta_1 \geqq 30$ sec and $\beta_1 \geqq 200$ psi (this requires two user-defined thresholds), (b) $\beta_3 \geqq 0.1$ psi sec (this test requires one user-fined threshold), and/or (c) $\beta_3 \leqq -0.1$ psi/sec (this test requires one user-defined threshold).

The actual kick thresholds used in a given situation should be set based on field history, well conditions and available simulations.

FIG. 4 shows the suggested flow algorithm for the calculations. First, we analyze the data to determine whether the downhole annular pressure trace can be accurately modeled using a linear equation for example, by determining whether:

$$\sum_{n=3}^{N-2}\left(\dot{p}(t_n)-\overline{\dot{P}}\right)^2-(N-4)\times\frac{\varepsilon^2}{2\times(\Delta t)^2}\leq(N-4)\times\frac{A^2}{2\times(\Delta t)^2} \quad (3)$$

where (A) is an allowable deviation set point representing the acceptable degree of error in the calculated value of $P_{static}$, and , $\overline{\dot{P}}$ is the mean of the pressure derivatives ($\dot{p}(t_n)$) for $t_3 \leqq t_N \leqq t_{N-2}$.

If the equation using the allowable deviation set point is satisfied, the downhole annular pressure trace is satisfactorily represented using a linear equation ($P_{Ann}(t)=-\beta_3\cdot(t-t_{End\text{-}of\text{-}connection})+P_{Static}$), then:

$$P_{Static}=\overline{P}-\overline{\dot{P}}\times(\bar{t}-t_{End\text{-}of\text{-}connection}) \quad (4)$$

where $\overline{P}$ is the mean of the pressures ($p(t_n)$) for $t_3 \leqq t_n \leqq t_{N-2}$, and $\bar{t}$ is the mean of the discrete times ($t_n$) for $t_3 \leqq t_n \leqq t_{N-2}$.

However, if the equation using the allowable deviation set point is not satisfied or the downhole annular pressure trace cannot be accurately modeled using a linear equation, i.e. when:

$$\sum_{n=3}^{N-2}\left(\dot{p}(t_n)-\overline{\dot{P}}\right)^2-(N-4)\times\frac{\varepsilon^2}{2\times(\Delta t)^2}\geq(N-4)\times\frac{A^2}{2\times(\Delta t)^2}$$

then we analyze the data to determine whether the downhole annular pressure trace can be accurately modeled using a linear plus exponential equation, for example, by determining whether:

$$\frac{-\sum_{n=3}^{N-2}\left(\dot{p}(t_n)-\overline{\dot{P}}\right)\times\left(\ddot{p}(t_n)-\overline{\ddot{P}}\right)}{\sqrt{\sum_{n=3}^{N-2}\left(\dot{p}(t_n)-\overline{\dot{P}}\right)^2-\frac{N-4}{2\times(\Delta t)^2}\times(\varepsilon^2+A^2)}\times\sqrt{\sum_{n=3}^{N-2}\left(\ddot{p}(t_n)-\overline{\ddot{P}}\right)^2-\frac{N-4}{(\Delta t)^4}\times 6\times(\varepsilon^2+A^2)}}\geq 0.9 \quad (5)$$

Thus, when the downhole annular pressure trace can be accurately modeled by a linear plus exponential equation: ($P_{Ann}(t)=\beta_1\cdot e^{-t/\vartheta^1}-\beta_3\cdot(t-t_{End\text{-}of\text{-}connection})+P_{static}$), then:

$$P_{Static}=\overline{P}-\frac{\sum_{n=3}^{N-2}|t_n-\bar{t}|\cdot(p(t_n)-\overline{P})}{\sum_{n=3}^{N-2}|t_n-\bar{t}|\cdot\left(\dot{p}(t_n)-\overline{\dot{P}}\right)}\cdot\overline{\dot{P}}-\frac{\sum_{n=3}^{N-2}|t_n-\bar{t}|\cdot(p(t_n)-\overline{P})-\frac{\sum_{n=3}^{N-2}|t_n-\bar{t}|\cdot(p(t_n)-\overline{P})}{\sum_{n=3}^{N-2}|t_n-\bar{t}|\cdot\left(\dot{p}(t_n)-\overline{\dot{P}}\right)}\cdot\sum_{n=3}^{N-2}|t_n-\bar{t}|\cdot\left(\dot{p}(t_n)-\overline{\dot{P}}\right)}{\sum_{n=3}^{N-2}(t_n-\bar{t})^2}\cdot\left(\bar{t}-t_N-\frac{\sum_{n=3}^{N-2}|t_n-\bar{t}|\cdot(p(t_n)-\overline{P})}{\sum_{n=3}^{N-2}|t_n-\bar{t}|\cdot\left(\dot{p}(t_n)-\overline{\dot{P}}\right)}\right) \quad (6)$$

However, if the modified equation using the allowable deviation set point is not satisfied or the downhole annular pressure trace cannot be accurately modeled using a linear plus exponential equation , i.e . when:

$$\frac{-\sum_{n=3}^{N-2}\left(\dot{p}(t_n)-\overline{\dot{P}}\right)\times\left(\ddot{p}(t_n)-\overline{\ddot{P}}\right)}{\sqrt{\sum_{n=3}^{N-2}\left(\dot{p}(t_n)-\overline{\dot{P}}\right)^2-\frac{N-4}{2\times(\Delta t)^2}\times(\varepsilon^2+A^2)}\times\sqrt{\sum_{n=3}^{N-2}\left(\ddot{p}(t_n)-\overline{\ddot{P}}\right)^2-\frac{N-4}{(\Delta t)^4}\times 6\times(\varepsilon^2+A^2)}}\leq 0.9$$

then we resort to a full solution of the linear plus exponential, plus a dampened harmonic oscillation equation (Eq-2). To determine the $P_{Static}$, a least-square fit (LSQF) technique is first used over the last 120 sec just prior to $t_{End\text{-}of\text{-}Connection}$ (i.e. the time interval $t\epsilon[t_{End\text{-}of\text{-}connection}-120\text{ sec}, t_{End\text{-}of\text{-}Connection}]$) and it is then repeated over the last 150 sec prior to $t_{End\text{-}of\text{-}connection}$, then over the last 180 sec, and so on, increasing the interval in 30 sec incremental steps every time. Every time we carry a LSQF, we compute a residual fit error per point, and we compare it to a preset value (which should be proportional to gauge resolution, or the acceptable error in determining the $P_{Static}$, whichever is larger). The LSQF process is stopped when the residual error exceeds the preset value. If the initial (the first) LSQF error already exceeds the preset value, then $P_{Static}$ is defaulted to the value of the last pressure reading marking the end of the connection, that is $p(t_{End\text{-}of\text{-}connection})$. When carrying out a LSQF however, there exists the very real danger of locking onto local minima, and it is preferred to first 'guess' some of the fitting parameters as accurately as possible prior to starting the LSQF process. This provides the initial (or 'start-up') values for the least-square fits. Since $P_{Static}$ is one of the fitted parameters along with $\vartheta$, $\beta_1$, $\beta_2$, $\beta_3$, $\omega$, then it will be directly solved for as part of the LSQF process.

It should be noted that the first 'guess' is only occasionally carried-out. In general the 'guess' will consist of those parameters resolved from the previous pressure trace obtained from the fit during the previous connection.

During the LSQF process, the various parameters may be bounded in one possible implementation as follows:

$\beta_1\epsilon[0\text{ psi}, 2000\text{psi}]$ $\vartheta_1\epsilon[0\text{ sec}, 360\text{sec}]$ (47)

$\omega\epsilon[\pi/25\text{ rad.sec}^{-1}, \pi/2\text{ rad.sec}^{-1}]$ $\beta_2\epsilon[-1000\text{ psi}, 1000\text{ psi}]$ (53)

$\phi\epsilon[-\pi\text{ rad}, +\pi\text{ rad}]$ $\vartheta_2\epsilon[0\text{ sec}, 60\text{ sec}]$ $\beta_3\epsilon[-1\text{ psi.sec}^{-1}, +1\text{ psi.sec}^{-1}]$ $P_{Static}\epsilon[p(t_N)-400\text{ psi}, p(t_N)+400\text{ psi}]$ After estimating $P_{Static}$, the ESD can be calculated by dividing by the TVD. However, this calculation will typically be performed at the surface where the driller or separate computer has better access to the depth of formations. The driller will then typically compare the ESD estimate to the actual mud weight measured at the surface and the estimated wellbore stability/pore pressure/fracture gradients, and may make changes as necessary to lighten or weight the mud to address any alarm conditions or to adjust the mud density for subsequent pipe connections.

The present invention may be implemented using a computer readable program code means. Through the use of analog and digital instruments, sensors and other data acquisition or processing equipment known in the art, a computer may take and record measurements of the downhole annular fluid pressures occurring during a connection, identify the onset of a pumps-off condition and a later-occurring end-of-connection condition, and estimate a downhole annular pressure trace from time of the pumps-off condition to the time of the end-of-connection condition. The computer could also effect calibrations of the equations developed to model the downhole annular pressure trace during subsequent connections by accessing actual downhole pressure measurements stored in the BHA after resumption of pumps-on operations, and reconciling the actual data against the modeled data obtained through use of the invention.

While the foregoing is directed to the preferred embodiment of the present invention, other and further embodiments of the invention may be devised without departing from the basic scope thereof, and the scope thereof is determined by the claims which follow.

DEFINITIONS

LSQF Least Square Fit.

CPU Central Processing Unit.

BHA Bottom Hole Assembly.

LWD Logging While Drilling tools.

MWD Measurement While Drilling tool. Collects downhole data from various LWD tools and transmits it to surface using mud-pulse telemetry.

APWD Annular Pressure While Drilling Sensor.

LTB Low-power Tool Bus (it provides a line of communication between the MWD and LWD tools and also supplies voltage to some of the LWD electronics).

PP Pore Pressure.

CG Collapse Gradient.

FG Fracture Gradient.

MD Measured Depth.

TVD True Vertical Depth.

$P_{Circulating}$ Downhole pressures while circulating.

ECD Equivalent Circulating Density.

$P_{Static}$ Static downhole pressure.

ESD Equivalent Static Density.

i, n Indexes (0,1,2,3, etc.)

t Time.

$t_0$ Time of the onset of the pumps-off condition.

$t_{End\text{-}of\text{-}connection}$ Time the end of the connection is detected. This is also referred to as ($t_N$).

$\Delta t$ Downhole pressure sampling rate (typically 2 sec).

$t_i$ Discrete times at which the downhole pressure measurements are made. Also, $t_i=t_0+i\times\Delta t$.

$t_N$ Same as $T_{End\text{-}of\text{-}connection}$.

$\bar{t}$ Mean of the discrete times ($t_n$) for $t_3\leqq t_n\leqq t_{N-2}$.

$\lambda$ Time span describing the recent history of downhole pressure changes.

$P_{Ann}(t)$ APWD pressure at time (t).

$P_{Min}$ Minimum APWD pressure during a pumps-off interval.

$P_{Max}$ Maximum APWD pressure during a pumps-off interval.

$P_{Ave}$ Average APWD pressure during a pumps-off interval.

$\overline{P}$ Mean of the pressures $P_{Ann}(t_n)$ for $t_3\leqq t_n\leqq t_{N-2}$.

$\dot{p}(t_n)$ Estimated first derivative of downhole pressure.

$\overline{\dot{P}}$ Mean of the pressure derivatives ($\dot{p}(t_n)$) for $t_3\leqq t_n\leqq t_{N-2}$.

$\ddot{p}(t_n)$ Estimated second derivative of downhole pressure.

$\ddot{P}_{Max}(t_n)$ Estimated maximum second derivative of downhole pressure for $t_n-\lambda\leqq t_i\leqq t_n\}$ $\ddot{P}_{Min}(t_n)$ Estimated minimum second derivative of downhole pressure for $t_n-\lambda\leqq t_i\leqq t_n\}$ $\epsilon$ Gauge resolution.
A Deviation set point.
$\eta$ Safety factor.
$\vartheta_1$ Time constant of the ballooning decay.
$\vartheta_2$ Time constants of the dampened oscillation decay.
$\omega$ Frequency of the BHA oscillation.
$\phi$ Phase.
$\beta_1$, $\beta_2$ Pressure amplitudes of various pumps-off transients.
$\beta_3$ Rate of pressure change with time.

We claim:

1. A method of determining a representative effective static downhole annular fluid pressure, comprising:

(a) measuring the downhole annular fluid pressure during a connection;

(b) identifying the onset of a pumps-off condition from the measured pressure;

(c) identifying an end-of-connection condition from the measured pressure; and (d) estimating an effective static downhole annular fluid pressure using only the downhole annular fluid pressure measurements between the onset of the pumps-off condition and the end-of-connection condition.

2. The method of claim 1, wherein steps (a) through (d) are performed by the bottom hole assembly.

3. The method of claim 2, wherein steps (a) through (d) are performed by an APWD assembly.

4. The method of claim 1, wherein the onset of the pumps-off condition and the end-of-connection condition are identified by detecting sudden changes in the downhole annular fluid pressure.

5. The method of claim 1, wherein the step of estimating the effective static downhole annular fluid pressure includes:

fitting the downhole annular fluid pressure measurements between the pumps-off condition and the end-of-connection condition to an equation.

6. The method of claim 5, wherein the equation represents the effective static downhole annular fluid pressure as equal to the downhole annular fluid pressure less the sum of pumps-off transients.

7. The method of claim 5, further comprising:

(e) determining a downhole annular fluid pressure at which the first derivative of the equation with respect to time is essentially zero.

8. The method of claim 7, wherein the pumps-off transients are identified as being dampened oscillations, exponential decay, linear decay, or combinations thereof.

9. The method of claim 6, wherein the step of fitting includes a least squares analysis.

10. The method of claim 7, wherein the step of estimating the effective static downhole annular fluid pressure includes:

identifing the downhole annular fluid pressure at which the first derivative of the annular fluid pressure measurements over time is essentially zero.

11. The method of claim 2, further comprising the step of transmitting the effective static downhole annular fluid pressure to the surface during a pumps-on condition after completion of the connection.

12. The method of claim 11, wherein the step of transmitting occurs promptly after beginning the next pumps-on condition.

13. The method of claim 12, wherein the step of transmitting includes the use of mud pulse telemetry.

14. The method of claim 1, further comprising the step of calculating the effective static density as the estimated effective downhole annular fluid pressure divided by the height of the hydrostatic head above the pressure measurement.

15. The method of claim 1, further comprising analyzing the downhole annular fluid pressure measurements between the pumps-off condition and the end-of-connection condition for an alarm condition.

16. The method of claim 15, wherein the alarm condition is selected from ballooning, gas kick, water kick, or combinations thereof.

17. The method of claim 6, wherein the equation is selected from linear, exponential, dampened-oscillator, or combinations thereof.

18. The method of claim 6, wherein the step of fitting the measurements to an equation comprises:

verifying and fitting the measurements to a linear equation; and determining the degree of accuracy achieved using a linear equation to represent the effective static downhole annular fluid pressure.

19. The method of claim 18, further comprising the step of:

(e) verifying and fitting the measurements to a linear plus exponential equation; and (f) determining the degree of accuracy achieved using a linear plus exponential equation to represent the effective static downhole annular fluid pressure.

20. The method of claim 19, further comprising the step of:

(g) fitting the measurements to a linear plus exponential plus dampened-oscillator equation.

21. The method of claim 1, wherein the step of estimating the effective static downhole annular fluid pressure includes:

determining a parameter of the downhole annular fluid pressure measurements between the onset of the pumps-off condition and the end-of-connection condition, wherein the parameter is selected from an average, minimum, mode, or mean.

22. The method of claim 1, wherein the step of estimating the effective static downhole annular fluid pressure includes:

determining an average, minimum, mode, or mean of the downhole annular fluid pressure measurements occurring prior to the end-of-connection condition.

23. The method of claim 18, wherein the equation used for determining the degree of accuracy achieved using a linear equation to represent the effective static downhole annular fluid pressure is:

$$\sum_{n=3}^{N-2}\left(\dot{p}(t_n)-\bar{\dot{P}}\right)^2-(N-4)\times\frac{\varepsilon^2}{2\times(\Delta t)^2}\leq(N-4)\times\frac{A^2}{2\times(\Delta t)^2}$$

and the linear equation is:

$$P_{ann}(t)=\beta_3(t-t_{End\text{-}of\text{-}connection})+P_{Static}$$

wherein:

$P_{Static}$ is the static downhole pressure;
n is an index;
t is time;
$t_0$ is time of the onset of the pumps-off condition;
$t_{End\text{-}of\text{-}connection}$ is the time at which the end of the connection is detected;
$\Delta t$ is the downhole pressure sampling, rate;
$t_i$ is discrete times at which the downhole pressure measurements are made;
$t_N$ is the same as $T_{End\text{-}of\text{-}connection}$;
$P_{Ann}(t)$ is APWD pressure at time (t);
$\dot{p}(t_n)$ is the estimated first derivative of downhole pressure;
$\bar{\dot{P}}$ is the mean of the pressure derivatives $(\dot{p}(t_n))$ for $t_3 \leqq t_n \leqq t_{N-2}$;
$\epsilon$ is gauge resolution;
A is a deviation set point; and
$\beta_3$ is the rate of pressure change with time.

24. The method of claim 18, wherein the equation used for determining the degree of accuracy achieved using a linear plus exponential equation to represent the effective static downhole annular fluid pressure is:

$$\frac{-\sum_{n=3}^{N-2}\left(\dot{p}(t_n)-\overline{\dot{P}}\right)\times\left(\ddot{p}(t_n)-\overline{\ddot{P}}\right)}{\sqrt{\sum_{n=3}^{N-2}\left(\dot{p}(t_n)-\overline{\dot{P}}\right)^2-\frac{N-4}{2\times(\Delta t)^2}\times(\varepsilon^2+A^2)}\times\sqrt{\sum_{n=3}^{N-2}\left(\ddot{p}(t_n)-\overline{\ddot{P}}\right)^2-\frac{N-4}{(\Delta t)^4}\times 6\times(\varepsilon^2+A^2)}}\geq 0.9$$

and the linear plus exponential equation is:

$$P_{ann}(t)=\beta_1\cdot e^{-t/pullout;zu702300.9001}-\beta_3\cdot(t-t_{End\text{-}of\text{-}connection})+P_{static}$$

wherein:

$P_{static}$ is the static downhole pressure;

n is an index;

t is time;

$t_0$ is time of the onset of the pumps-off condition;

$t_{End\text{-}of\text{-}connection}$ is the time at which the end of the connection is detected;

$\Delta t$ is the downhole pressure sampling rate;

$t_i$ is discrete times at which the downhole pressure measurements are made;

$t_N$ is the same as $T_{End\text{-}of\text{-}connection}$;

$P_{Ann}(t)$ is APWD pressure at time (t);

$\dot{p}(t_n)$ is the estimated first derivative of downhole pressure;

$\overline{\dot{P}}$ is the mean of the pressure derivatives($\dot{p}(t_n)$) for $t_3 \leqq t_n \leqq t_{N-2}$;

$\overline{\dot{P}}$ is the mean of the second pressure derivatives ($\ddot{p}(t_n)$) for $t_3 \leqq t_n \leqq tN-2$;

$\ddot{p}(t_n)$ is the estimated second derivative of downhole pressure;

$\epsilon$ is gauge resolution;

A is a deviation set point;

$\beta_1$ is pressure amplitudes of various pumps-off transients; and $\beta_3$ is the rate of pressure change with time.

25. The method of claim 20, wherein the linear plus exponential plus dampened oscillation equation is:

$$P_{ann}(t)=\beta_1 e^{-t/\vartheta_1}+\beta_2\times e^{-t/\vartheta_2}\sin(\omega t+\phi)-\beta_3(t-t_{End})+P_{Static}$$

wherein:

$P_{Static}$ is the static downhole pressure;

t is time;

$t_{End\text{-}of\text{-}connection}$ is the time at which the end of the connection is detected;

$P_{Ann}(t)$ is APWD pressure at time (t);

$\vartheta_1$ is the time constant of the ballooning decay;

$\vartheta_2$ is the time constant of the dampened oscillation decay;

$\omega$ is the frequency of the BHA oscillation;

$\phi$ is the phase;

$\beta_1$, $\beta_2$ are pressure amplitudes of various pumps-off transients; and $\beta_3$ is the rate of pressure change with time.

* * * * *